US006958017B1

(12) United States Patent
Toombs, Jr.

(10) Patent No.: US 6,958,017 B1
(45) Date of Patent: Oct. 25, 2005

(54) PORTABLE SWING ASSEMBLY

(76) Inventor: Billy A. Toombs, Jr., P.O. Box 38924, Colorado Springs, CO (US) 80937

( * ) Notice: Subject to any disclaimer, the term of this patent is extended or adjusted under 35 U.S.C. 154(b) by 0 days.

(21) Appl. No.: 10/928,557

(22) Filed: Aug. 29, 2004

(51) Int. Cl.[7] ..... A63G 9/00
(52) U.S. Cl. ..... 472/118; 472/125; 297/273
(58) Field of Search ..... 472/118–125; 297/273, 115–117

(56) References Cited

U.S. PATENT DOCUMENTS 3,256,016 A * 6/1966 Berlin ..... 472/118
3,363,939 A * 1/1968 Gross ..... 297/116
3,459,423 A * 8/1969 Meade ..... 472/119
3,990,667 A * 11/1976 Tomalinas, Jr. ..... 248/370
4,256,300 A * 3/1981 Boucher ..... 472/118
4,898,198 A * 2/1990 Castlebury ..... 135/90
6,017,007 A * 1/2000 Muzzi ..... 248/163.2
6,019,427 A * 2/2000 Combest ..... 297/277

* cited by examiner

*Primary Examiner*—Kien Nguyen

(57) ABSTRACT

The invention is a unique swing assembly which is designed to fit into a carrying case when the components of the assembly are dismantled. The swing of the assembly comprises a seat and back rest which are hinged together so that they can be easily and quickly mounted in a support frame that is composed of parts that are detachably fastened together so that they can be readably dismantled for storage in the carrying case. The swing can be provided with arm rests which are also detachably mounted to the seat and back rest.

10 Claims, 2 Drawing Sheets

PORTABLE SWING ASSEMBLY

BACKGROUND OF THE INVENTION

The invention relates to swings, especially to a lightweight, portable swing assembly which can be easily and quickly assembled and disassembled for compact storage in a carrying case. Such an assembly is particularly designed for use in and around the home, such as the garden, patio area, pool, or spa area, as well as the favorite porch or shade tree where people like to sit and enjoy leisure time, after which such an assembly can be quickly disassembled and transported to another desirable location by recreational vehicles, such as trucks and campers and even automobiles.

U.S. Pat. No. 4,537,392 discloses a foldable swing set in which the so called folding process requires the complete dismantling of all of the components of the set, as shown in FIG. 2 of the patent. It can be appreciated that this patent is not directed to the easiest and quickest way of assembling and disassembling a swing set, thereby highly diminishing the portable of the swing set. This patent makes no attempt to simplify the building and dismantling processes by standardizing or combining the number of parts.

Applicant's invention provides a unique portable swing assembly in which the various components of the assembly, especially those of the swing itself, are simply designed and fabricated for quick and easy partial disassembly that is sufficient to store the broken down or collapsed assembly in a carrying case which is easy transported,

DESCRIPTION OF THE DRAWINGS

The following description of the invention will be better understood by having reference to the accompanying drawing wherein.

DETAILED DESCRIPTION OF THE DRAWINGS

Figure 1:
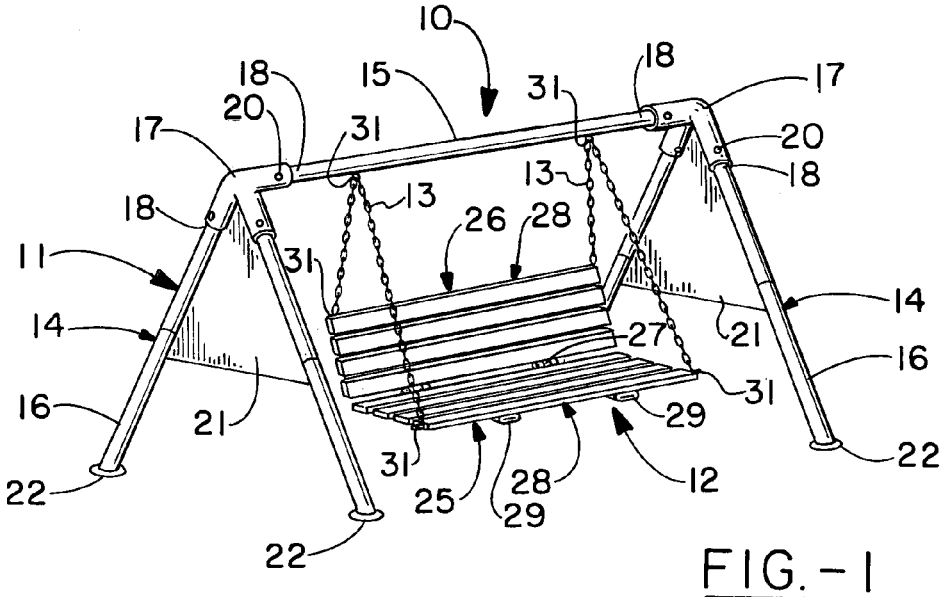
FIG. 1 is a perspective view of an early embodiment of the invention which comprises a swing stand or support frame and a swing that is mounted for swinging relation on the support frame, the swing being comprised of a swing seat and backrest.
Figure 2:
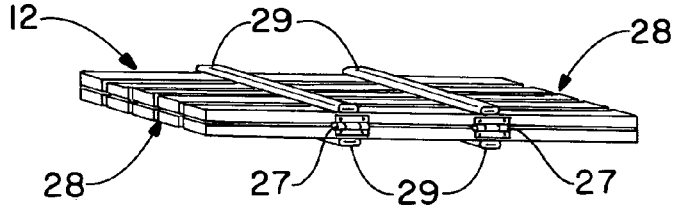
FIG. 2 is a perspective view of the swing itself, showing the swing seat and back rest folded together in a collapsed position.
Figure 3:
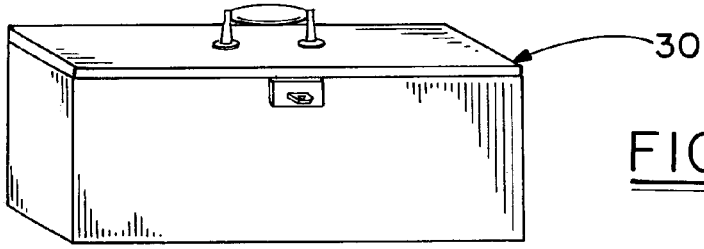
FIG. 3 is a perspective view of a typical carrying case in which components of the swing assembly can be stored and transported.
Figure 4:
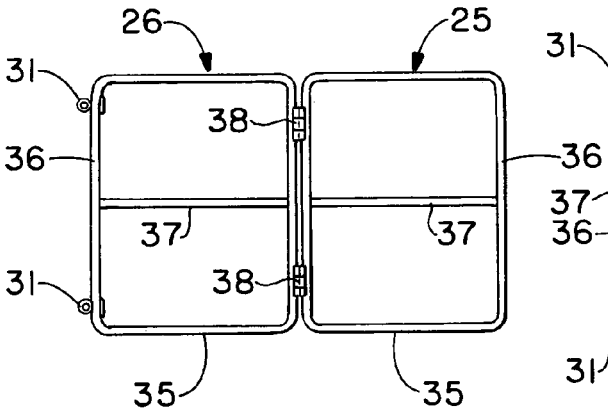
FIG. 4 is a plan view of a pair of hinged tubular frames of an improved seat and back rest.
Figure 5:
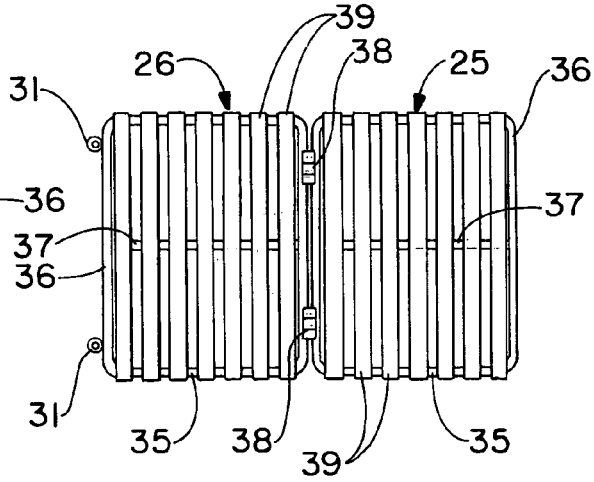
FIG. 5 is a plan view of the tubular frames with people supporting slats applied thereto in spaced relation.

With general reference to the drawing for like parts, and particular reference to FIGS. 1–3, there is shown a portable swing assembly 10 which essentially comprises a swing supporting frame 11, a swing 12, and a plurality of conventional link chains 13 for mounting the swing 12 in swing relation on the support frame 11.

Figure 8:
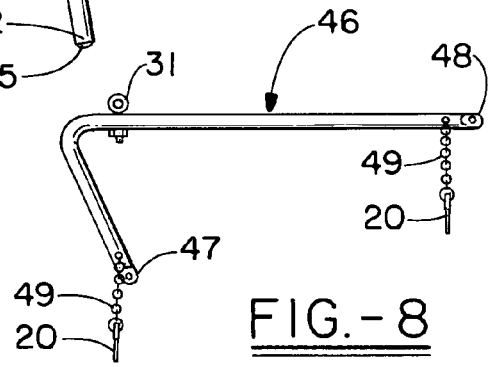
FIG. 8 is an enlarged side view of an arm rest which can be detachably mounted on the opposing ends of the swing.
Figure 9:
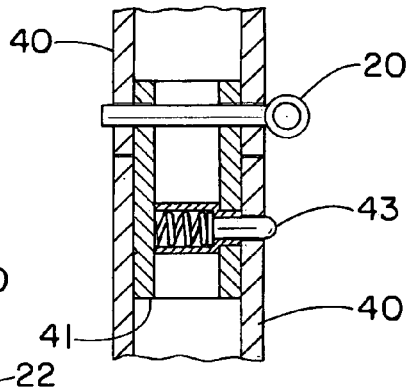
FIG. 9 is a partial section of two axially joined leg sections of each leg of the support frame of the swing assembly of FIGS. 6 and 7, such section designed to show different means for detachably fastening or joining the two leg sections together in abutting end-to-end relation.

The support frame 11 comprises a pair of similar, but oppositely disposed inverted V-shaped (IV) frames 14 which support between them, an overhead, rigid, hollow tubular cross beam 15 from which the swing 12 is suspended by means of the link chains 13. Each one of the IV-frames 14 is comprised of a pair of similar, hollow tubular legs 16 which converge towards each other in a direction towards the overhead cross beam 15. Each pair of legs 16 terminate at a conventional 3-way hub or fitting 17 to which adjacent ends 18 and 19 of the legs 16 and cross beam 15, respectively, are detachably fastened by any suitable means, e.g. conventional drift or cinch pins 20 with rotatably attached eyelets, as best seen in FIGS. 8 and 9. Any appropriate structural member, such as a comparatively narrow but rigid flat plate 21, is detachably fastened to the two legs 16 of each IV-frame 14 in equal spaced relation from the hub 17 to prevent the opposing free ends 22 of the legs 16 from spreading to cause the IV-frames 14 to collapse.

The swing 12 comprises a seat 25 and a back rest 26 which are mounted together for relative rotation by any suitable means, e.g. a pair of conventional knuckle type hinges 27 or a single, coextensive piano-type hinge (not shown). The seat 25 and back rest 26 are similarly sized and constructed of a number of relatively thin wood slats 28 which are firmly secured in spaced transverse relation to a pair of parallel, hollow structural members 29, with square or rectangular cross sections, by any suitable means such as counter sunk, flat headed screws, or bolts and nuts and lock washers. The seat 25 and back rest 26 are designed to be rotated between an open position, where the back rest 26 is inclined at an angle A of at least 90 degrees from the seat 25, to a closed position, where the seat 25 and back rest 26 are folded together against each other in abutting, juxtaposed relation, as best seen in FIG. 2 to fit with the other components of the swing assembly 10 in the rectangular carrying case 30 (FIG. 3) which can be made of any appropriate material, such as wood, metal, plastic or a fabric such as canvas.

The outermost slats 28 of the seat 25 and back rest 26, relative to the innermost slats 26 thereof which are hinged together, are provided with standard screws with eyes 31 for detachably receiving conventional snap lock clasps 32 at the adjacent free ends of the link chains 13 which are detachably mounted by similar clasps 32 to similar but enlarged eyes 31 of conventional eye bolts which are secured to the supporting cross beam 15. It can be appreciated that each of the link chains 13 can be two separate chains of different lengths, or a single chain which is provided with a similar, intermediately disposed clapse 32 which, in effect, divides the chain into the two chains of different lengths, as previously described.

With particular reference to FIGS. 4–9, there is shown the latest portable swing assembly 33 which is highly improved from the original model or assembly 10 which is shown in FIG. 1 and described above. The improved assembly or model 33 is comprised of two, identical rectangular frames 35 for the seat 25 and back rest 26 which, in this instance, are designed to accommodate a single person, but which can be increased, in size, and taylored to hold two or more people sitting in side-by-side relationship. The frames 35 are composed of any suitable material, e.g. wood, plastic, or metal such as aluminum. Each of the frames 35 is preferably made from a continuous, outer hollow cylindrical, lightweight metal tube 36 which has a circular cross section, rather than a square or rectangular cross section, because such cylindrical or round metal tubes are easier to bend and form into a rectangular frame with slightly rounded corners. A similar hollow cylindrical inner metal tube 37 is secured, for example, by welding equidistant between the longer sides of the frame 35 to, in effect, divide the frame 35 longitudinally into two equal and smaller frames to rigidity the frame 35. More than one, similar inner metal tubes 37 are provided when the tubular frames 35 are designed to hold more than one person. The two identical frames 35 are hinged together by two, similar, knuckle-type hinges 38. Notice that the outermost side of only the back rest 26 is provided with conventional eye bolts to which the shorter length link chains 13 are detachably fastened.

A number of similar, relatively narrow and thin slats 39, composed of ¼" to ⅜" thick strips of wood, plastic, or lightweight metal such as aluminum, are secured to the tubular frames 35 in spaced relation by any suitable means, such as metal screws or nuts and bolts, as previously described. It has been found, that the most comfortable sitting position is achieved when the included angle •A • between the swing seat 25 and back rest 26 is about 110 degrees, as best seen in FIG. 7.

It is also important and preferable, from a production standpoint to standardize the length and size of the hollow cylindrical legs 16 of the support frame 11. This is accomplished by making all of the legs 16 the same length. It has been found that single legs, when used are simply too long to fit into a carrying case 30 which is sized for easy handling. Accordingly, each one of the legs 16 is comprised of two identical leg sections 40 which are of equal length and diameter. Any suitable means can be used to detachably join and rigidly maintain two leg sections 40 in abutting, axially aligned, end-to-end relation. An excellent way of doing this is to use strong connecting sleeves 41, as best seen in FIG. 9. Such sleeves 41 are rigid hollow cylinders which have an outer diameter that is slightly less than the inner diameter of the leg sections 40, so that the sleeves 41 fit snugly within the leg sections 40. Abutting ends of the leg sections 40 are provided with transversely aligned holes which are aligned with similarly transversely aligned holes in the connecting sleeves 41, such aligned holes being designed to detachably receive conventional drift or cinch pins 20, as previously described, for holding the leg sections 40 and sleeves 41 firmly together. Alternatively, the sleeves 41 can be provided with spring loaded bullet catches 43 for movement into aligned holes in the leg sections 40. Thus, it can be appreciated that one-size leg sections 40 need be manufactured to greatly simplify the quick and easy foldability and consequent portability of this new and improved swing assembly 33.

Figure 6:
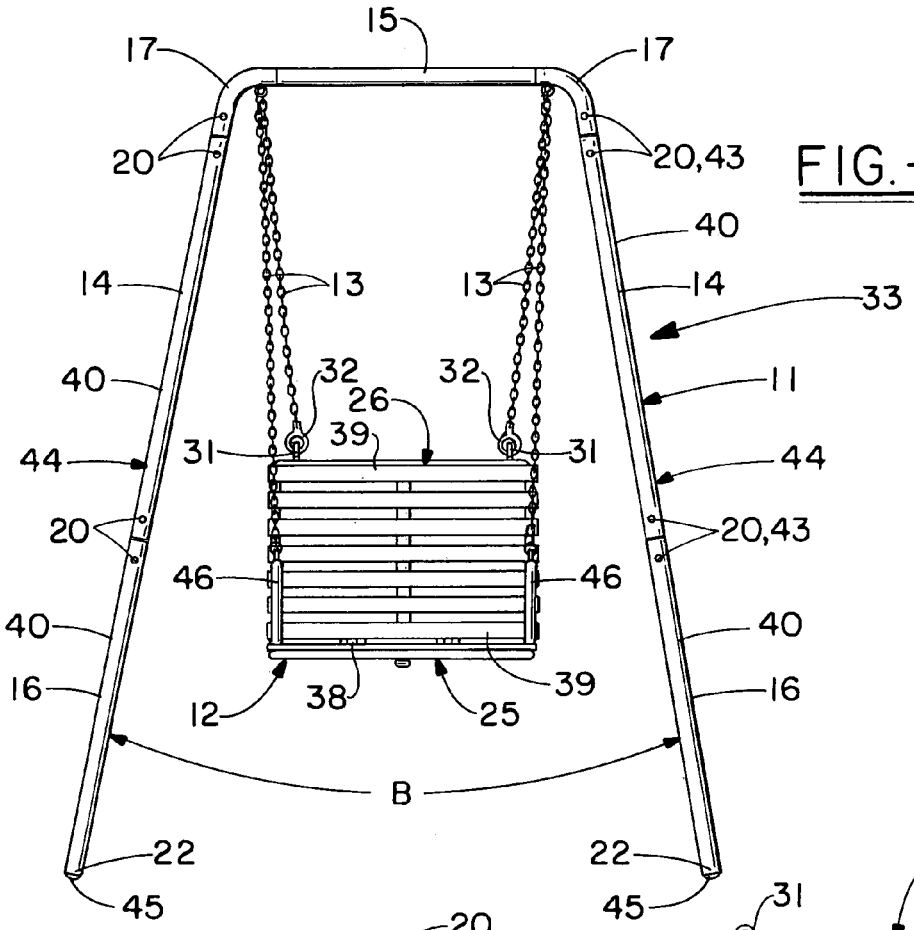
FIG. 6 is a front view of the latest portable swing assembly which is made in accordance with the invention.

The legs 16 and attached 3-way hubs or fittings 17, adjacent opposing ends of the swing 12 of the new and improved swing assembly 33, form a pair of opposing IV-frames 44 which, as best seen in FIG. 6, are angularly disposed to each other, such that the included angle •B• between intersecting planes containing such IV-frames 44 is about 20 degrees. Further, as best seen in FIG. 7, the included angle •C• between the legs 16 of each of the IV-frames 44, is about 40 degrees. Such angular dispositions of the IV-frames 44 and legs 16 of each IV-frame 44, are achieved by the 3-way hubs or fittings 17 wherein, I) the axes of each hub 17 for the attachments of the cross beam and the legs of the adjacent IV-frame 44 are angularly disposed such that the included angle between such axes of each hub 17 is 100 degrees, plus or minus any machining tolerances, and ii) the axes of each hub 17 for the attachments of the legs of each IV-frame are angularly disposed, such that the included angle between said axes is 40 degrees. These angular relationships, as best seen in FIGS. 6 and 7 eliminate the need for the cross ties 21, shown in FIG. 1. The free end 22 of each leg 16 is provided with a rubber, plastic, or metal foot 45.

Figure 7:
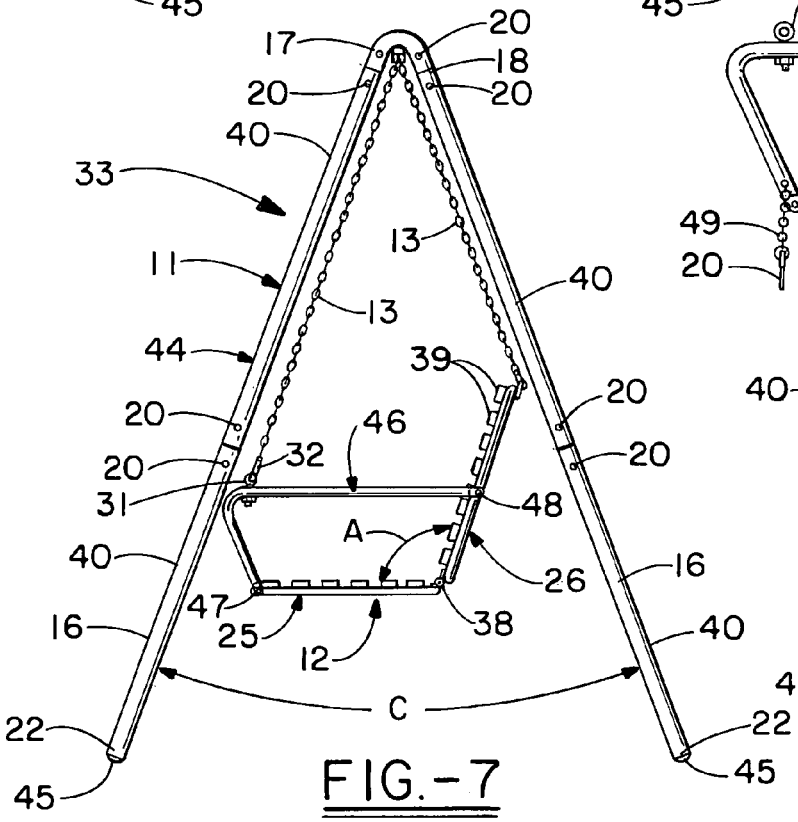
FIG. 7 is a side view of the swing assembly of FIG. 6.

A combination flat and curved arm rest 46, as best seen in FIGS. 7 and 8, is provided at each of the opposing ends of the swing 12. Each arm rest 46 is made of any suitable lightweight material, such as aluminum and has a square or rectangular cross section and a pair of opposing ends 47 and 48 which are bifurcated for receiving adjacent portions of the tubular frames 35 of the seat 25 and back rest 26. The bifurcated ends 47 and 48 each have axially aligned holes for alignment with similar axially aligned holes in the adjacent portions of the tubular frames 35 to detachably receive similar drift pins 20 for holding the arm rests 46 firmly to the seat 25 and back rest 26. Note that the drift pins 20, shown in FIG. 8, are attached to the arm rest 46 by means of a short length of link chain 49. It is recommended that all of the drift pins 20, if such be used, be similarity attached adjacent the spots where they are intended to be used to prevent them from getting lost or being misplaced. The arm rests 44 can be hinged to the seat 25 to further facilitate assembly and disassembly of the improved swing assembly 33. The arm rests 44 are each provided with a conventional eye bolt, as seen in FIG. 8, for detachably receiving a longer length of the link chains 13.

The new and improved portable swing assembly 33 is ideally suited to hold one or two people, although the inventive concept can be used to provide customized portable swing assemblies to accommodate more than two people. Also, the longer overhead support beam 15 for the two member swing assembly 33 can be easily adapted to hold two, one member swings in side-by-side swinging relation. For example, the longer cross beam 15 can be provided with four eye bolts which are spaced to accommodate a two member swing or two one member swings. Moreover, one of the one member swings can be replaced with a spring supported small child's swing which can also act as a well known jumper for the child. Thus, a parent can swing with their child which is free to swing or jump whichever the child desires. Many different combinations are possible, depending on the kind and number of removable attachments provided on the support beam 15.

Thus, there has been described a unique portable swing assembly in which components of the assembly have been standardized and partially assembled to facilitate putting the swing assembly together and taking it apart for storage in an easily handled carrying case. It can be appreciated from the above description that, with the exception of the eye bolts, no tools are needed to put together and dismantle this swing assemble when cinch pins 20 or spring loaded bullet catches are used to detachably fastened the components of the swing assembly together, but even then wing nuts can be used in place of regular flat nuts to hand tighten the eye bolts on the cross beam.

What is claimed is:

1. A portable swing assembly, comprising:

a) a swing which includes; I) a seat which has a lightweight, rigid metal frame which has one side thereof covered by a plurality of narrow and relatively thin slats which are secured in spaced relation to the frame on the one side, the seat being designed to receive and hold at least one person sitting on the slats of the seat, II) a back rest which has a metal frame that is identical to that of the seat and, likewise, has one side similarly covered with similar slats, II) means for hinging the seat and back rest together for rotation between an open position, where the back rest is vertically inclined at an angle of at least 90 degrees from the seat when the seat is horizontal, and a closed position where the slats of the seat and back rest are folded against each other, b) a frame for supporting the swing, the support frame, including, IV) a sturdy cross beam from which the swing is suspended, V) a pair of inverted V-frames at opposing ends of the cross beam for supporting the cross beam, each of the inverted V-frames having a pair of legs which converge towards each other in the direction of the cross beam, the legs of each pair of legs terminating at a rigid 3-way hub to which adjacent converged ends of the legs and cross beam are detachably fastened, the hubs holding the legs of each pair of legs in predetermined, fixed angular relation and in a plane which is also in predetermined fixed angular relation to the plane of the cross bean, such that each of the inverted V-frames are free of any cross ties which are secured between the legs of each inverted V-frame to prevent spreading thereof, each of the legs being comprised of a pair of identical leg sections and means for detachably joining each pair of leg sections in rigid, axially aligned end-to-end relation; and c) link chains detachably fastened to the swing and cross beam for suspending the swing from the cross beam, such that the seat will be in a generally horizontal still position, when the swing is not swinging, the portable swing assembly, when dismantled into it's essential components of a seat, back rest, support beam, hub, legs and chains, fits into a carrying case in which the dismantled swing assembly can be transported, by hand, from one place to another.

2. The swing assembly of claim 1, wherein I) the frames of the seat and back rest are made of hollow, cylindrical aluminum tubes, and ii) the slats of the seat and back rest are made of material of the group of wood, plastic and metal materials.

3. The swing assembly of claim 2, wherein the included angle between the legs of each inverted V-frame is about 40 degrees, and the included angle between the plane of each inverted V-frame and the plane of the cross beam is about 100 degrees.

4. The swing assembly of claim 3, wherein the means for detachably joining the leg sections of each leg, comprises, V) a rigid, hollow cylindrical sleeve which has an outer diameter that is slightly less than the inside diameter of the leg sections, so that the sleeve fits snugly within the leg sections, the sleeve being sufficiently long to span the joint between the leg sections and make rigid the joint, and VI) means for detachably fastening adjacent abutting ends of the leg sections to the sleeves therein, said means including fasteners of the group of cinch pins and spring loaded button catches.

5. The swing assembly of claim 4, which includes;

e) a pair of lightweight, hollow tubular metal arm rests at each of the opposing ends of the swing, the arm rests each having a rectangular cross section, and f) means for detachably fastening the arm rests to the swing, including cinch pins.

6. The swing assembly of claim 5, wherein the arm rests each have a pair of opposing bifurcated ends for receding and detachable fastening to adjacent portions of the tubular frames of the seat and back rest.

7. The swing assembly of claim 5, wherein the fastening means of the arm rests includes means for hinging the ends of the arm rests, closest the seat, to the seat for rotating the arm rests towards each other below the slats and tubular frame of the seat.

8. The swing assembly of claim 5, wherein the link chains extend from the cross beam to, I) opposing ends of the back rest, and II) the arm rests in spaced relation from the back rest, the link chains to the arm rests being longer than the link chains to the back rest.

9. The swing assembly of claim 5, wherein the cross beam is a rigid, hollow cylindrical metal beam which is sufficiently long with conventional eye bolts spaced longitudinally thereof to alternately accommodate, m) a single swing which will hold two people sitting on the seat thereof in side-by-side relation, and n) a pair of separate swings in side-by-side relation, each of which swings can hold one person.

10. A portable swing assembly, comprising:

a) a swing designed to accommodate at least one person, comprising, I) a seat and back rest, both of which have identical rectangular shaped frames which are made of lightweight, hollow, cylindrical metal tubing, the frames each having at least one planar side which is covered by a plurality of spaced, narrow and relatively thin slats, II) means for hinging adjacent inner sides of the seat and back rest tubular frames for rotation between an open position, where the slats on the frames are exposed for contact with a person sitting on the swing, and a closed position, where the frames are folded together where the slats of the frames abut each other, and III) a pair of conventional eye bolts secured in spaced relation on the outer side of the tubular frame of the back rest farthest spaced from the hinge side of the frame, b) a support frame for supporting the swing, comprising, IV) a rigid, hollow cylindrical cross beam from which the swing is suspended, the cross beam having a pair of conventional eye bolts which are detachably fastened to the cross beam and which extend therefrom in the direction of the eye bolts on the back rest of the swing, V) a pair of similar, but oppositely disposed inverted V-frames supporting the cross beam between them, each of the inverted V-frames including a pair of legs which converge towards each other in the direction of the cross bean and terminate at a hub to which adjacent ends of the legs and cross beam are detachably fastened by fasteners of the group of cinch pins and spring loaded button catch type fasteners, each of the legs being composed of two identical hollow cylindrical leg sections which have the same length, and inside and outside diameters, VI) means for detachably joining and maintaining the leg sections in rigid, axially aligned, abutting end-to-end relation, said means including, I) a rigid, hollow cylindrical sleeve which has an outer diameter which is slightly less than the inside diameter of the leg sections, such that the sleeve will fit snugly within the leg sections, the sleeve being sufficiently long to span the joint between the leg sections and make the joint rigid, and ii) means for detachably fastening each sleeve and adjacent ends of the leg sections together, said means including fasteners of the group of cinch pins and spring loaded bullet catch type fasteners, and VII) the support frame being dismantled into a number of individual parts, the inverted V-frames diverge in a direction away from the cross beam, such that the included angle between them is about 20 degrees, the legs of each inverted V-frame also diverge in a direction away from the cross beam, such that the included angle between them is about 40 degrees, such angular relationships produced by the 3-way hubs, each of which hubs has portions thereof to which the cross beam and pair of legs are detachably fastened in axial alignment with axes of said portions, the first and second axes of the portions to which the legs are fastened being angularly disposed, such that the include angle between said first and second axes is 40 degrees, excluding manufacturing tolerances, and the third axis of the portion to which the cross beam is fastened being angularly disposed to the first and second axes, such that the include angle between intersecting planes containing the first and second axes and the third axis is 100 degrees, excluding manufacturing tolerances, and the free end of each leg includes a detachable foot which is composed of a material of the group of rubber, plastic and metal materials:

c) a pair of arm rests detachably fastened to the swing at opposing sides thereof, each of the arm rests having an eye bolt for securing the arm rest to the respective link chain, each of the arm rests having a cross section of the group of circular, square and rectangular cross sections, d) means coacting between the eye bolts on the arm rest, swing and cross beam for suspending the swing from the cross beam, such that the swing is open and the seat thereof is generally horizonal in a still position, said means including at least one pair of link chain and e) a hand held carrying case for receiving the folded seat and back rest, the cross beam, the hubs, the leg sections and sleeves, the arm rests and the link chains of the swing assembly.

* * * * *